US007428401B2

(12) United States Patent
Oonishi

(10) Patent No.: US 7,428,401 B2
(45) **Date of Patent: *Sep. 23, 2008**

(54) BELT-TYPE FIXING DEVICE

(75) Inventor: Taizou Oonishi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 4 days.

This patent is subject to a terminal disclaimer.

(21) Appl. No.: 10/805,228

(22) Filed: Mar. 22, 2004

(65) Prior Publication Data

US 2004/0184848 A1 Sep. 23, 2004

(30) Foreign Application Priority Data

Mar. 20, 2003 (JP) ..... 2003-077069

(51) Int. Cl.
*G03G 15/20* (2006.01)

(52) U.S. Cl. ..... 399/329; 399/330; 399/333

(58) Field of Classification Search ..... 399/328–330, 399/333, 400

See application file for complete search history.

(56) References Cited

U.S. PATENT DOCUMENTS

| | | | | |
|---|---|---|---|---|
| 4,563,073 | A | 1/1986 | Reynolds | |
| 5,237,368 | A * | 8/1993 | Itoh et al. | 399/328 |
| 5,602,635 | A * | 2/1997 | Domoto et al. | 399/328 |
| 5,960,243 | A | 9/1999 | Daigo et al. | |
| 5,999,788 | A * | 12/1999 | Kanesawa et al. | 399/329 |
| 6,055,390 | A * | 4/2000 | Kurotaka et al. | 399/329 |
| 6,795,678 | B2 * | 9/2004 | Yura et al. | 399/329 |
| 6,807,386 | B2 * | 10/2004 | Yasui et al. | 399/329 |
| 6,853,832 | B2 * | 2/2005 | Noya et al. | 399/328 |
| 6,865,366 | B2 * | 3/2005 | Katayanagi et al. | 399/328 |
| 6,898,410 | B2 * | 5/2005 | Boss | 399/328 |
| 2004/0033092 | A1 * | 2/2004 | Aruga | 399/329 |
| 2005/0025538 | A1 * | 2/2005 | Omata | 399/329 |
| 2005/0025539 | A1 * | 2/2005 | Yoshinaga | 399/329 |

(Continued)

FOREIGN PATENT DOCUMENTS

JP 61-110179 A 5/1986

(Continued)

OTHER PUBLICATIONS

Japanese Office Action dated Jun. 5, 2007 and English language translation, directed to counterpart JP Application No. 2003-077069 (5 pages).

*Primary Examiner*—Yaritza Guadalupe-McCall
(74) *Attorney, Agent, or Firm*—Morrison & Foerster LLP

(57) ABSTRACT

A belt-type fixing device is provided that achieves reduction in time required between start of rotation of a fixing belt upon reception of print starting signal in printing-standby status and recovery of a specified fixation temperature in a fixing nip.

The belt-type fixing device of the invention has an endless-sheet-like fixing belt to be heated, a nip forming member positioned inside the fixing belt, a rotatable pressurizing roller which is in pressure contact with the nip forming member with the fixing belt interposed between and in which part in contact with the fixing belt forms a fixing nip, and a heater lamp for heating the fixing belt which lamp is provided in a position inside the fixing belt and away from the fixing nip, and the fixing nip is in a position higher than the heater lamp.

5 Claims, 4 Drawing Sheets

U.S. PATENT DOCUMENTS

| | | | | |
|---|---|---|---|---|
| 2007/0264060 | A1* | 11/2007 | Ueno et al. | 399/330 |
| 2007/0274748 | A1* | 11/2007 | Yoshikawa | 399/329 |
| 2008/0013995 | A1* | 1/2008 | Kubota et al. | 399/333 |
| 2008/0056783 | A1* | 3/2008 | Yamamoto et al. | 399/329 |
| 2008/0124152 | A1* | 5/2008 | Nishikawa et al. | 399/336 |

FOREIGN PATENT DOCUMENTS

| | | | |
|---|---|---|---|
| JP | 63098683 | A * | 4/1988 |
| JP | 10-20691 | A | 1/1998 |
| JP | 2000-221817 | A | 8/2000 |
| JP | 2000-330412 | | 11/2000 |
| JP | 2002-287561 | A | 10/2002 |

* cited by examiner

BELT-TYPE FIXING DEVICE

RELATED APPLICATION

This application is based on Japanese Patent Application No. 2003-77069, the content of which is incorporated herein by reference.

BACKGROUND OF THE INVENTION

The present invention relates to a belt-type fixing device that is used in an electrophotographic image forming apparatus.

In Japanese Patent Laid-Open Publication 2000-330412 has been disclosed a belt-type fixing device 50 shown in FIG. 4, for example. The belt-type fixing device 50 has an endless-sheet-like fixing belt 58, a rotatable heating roller 54 which has a heater 52 therein, and a rotatable fixing roller 56 which is away from the heating roller 54 and which has an elastic layer composed of rubber, for example, on an outer circumference thereof. The fixing belt 58 is wound around the heating roller 54 and the fixing roller 56. Furthermore, the belt-type fixing device 50 has a pressurizing roller 60 which can be driven to be rotated, which is in pressure contact with the fixing roller 56 through the fixing belt 58, and in which part in contact with the fixing belt 58 forms a fixing nip 62.

When the pressurizing roller 60 is driven to rotate in a direction of an arrow C in the belt-type fixing device 50, the fixing belt 58 rotates in a direction of an arrow D. While rotating in such a manner, the fixing belt 58 is subjected to heat transfer from the heating roller 54 heated by the heater 52, so that a temperature of the fixing belt 58 rises to a specified fixation temperature (e.g., to 180° C.). After the fixing belt is heated so as to have the specified fixation temperature, a paper having an unfixed toner image formed on an upper surface thereof is introduced into the fixing nip 62 in a direction of an arrow E, and the toner image is heated and fixed on the paper while the paper is passed through the fixing nip 62.

While the belt-type fixing device 50 is standing by for printing, a temperature of the heating roller 54 is kept at the specified fixation temperature by the heater 52 whereas temperatures decrease in the fixing roller 56, the pressurizing roller 60, and part of the fixing belt 58 that forms the fixing nip 62, which are away from the heating roller 54, because the fixing belt 58 is at rest. A problem therefore occurs in that it takes much time for the fixing nip 62 to retrieve the specified fixation temperature when the fixing belt 58 starts rotating upon reception of print starting signal.

SUMMARY OF THE INVENTION

An object of the present invention is to provide a belt-type fixing device that achieves reduction in time required between reception of print starting signal in printing-standby status and recovery of a specified fixation temperature in a fixing nip.

In order to achieve the object, a belt-type fixing device in accordance with a first aspect of the invention has an endless-sheet-like fixing belt to be heated, a fixing member positioned inside the fixing belt, a rotatable pressurizing roller which is in pressure contact with the fixing member with the fixing belt interposed between and in which part in contact with the fixing belt forms a fixing nip, and a heat source for heating the fixing belt which heat source is provided in a position inside the fixing belt and away from the fixing nip, wherein the fixing nip is in a position higher than the heat source.

In the belt-type fixing device of the first aspect of the invention, the heat source may be positioned in the rotatable heating roller, and the fixing belt may rotatably be wound around the heating roller and the fixing member.

The belt-type fixing device of the first aspect of the invention may be provided with a cover that covers a space above the fixing nip.

In the belt-type fixing device of the first aspect of the invention, the fixing member may be a nip forming member that is fixed so as to be incapable of rotating or may be a rotatable fixing roller having an elastic layer on an outer circumference thereof.

A belt-type fixing device in accordance with a second aspect of the invention has:

a first pressurizing member, a heating roller that is in a position lower than the first pressurizing member, a belt member wound around the first pressurizing member and around the heating roller, and a second pressurizing member that is provided in relative pressure contact with the first pressurizing member through the belt member.

In the belt-type fixing device in accordance with the second aspect, the second pressurizing member may be provided in a position generally horizontal with respect to the first pressurizing member, and a paper that undergoes fixation may be conveyed vertically in general from lower side to upper side.

In the belt-type fixing device in accordance with the second aspect, the first pressurizing member may be a fixed member and the second pressurizing member may be a roller.

An image forming apparatus of the invention has:

image forming units for forming toner images on a paper, a first pressurizing member, a heating roller that is in a position lower than the first pressurizing member, a belt member wound around the first pressurizing member and around the heating roller, a second pressurizing member that is provided in relative pressure contact with the first pressurizing member through the belt member, and a paper conveying unit for conveying the paper on which the toner images have been formed by the image forming units, vertically in general from lower side to upper side, so that the paper is passed through nip part formed between the belt member and the second pressurizing member.

In the image forming apparatus of the invention, the first pressurizing member may be a fixed member and the second pressurizing member may be a roller.

In accordance with the invention, the fixing nip is in the position higher than the heat source provided inside the fixing belt, surrounding air heated by the heat source therefore moves toward the fixing nip-by convection in printing-standby status in which the fixing belt is at rest, and the fixing member (or the first pressurizing member) and the pressurizing roller (or the second pressurizing member) that form the fixing nip are thereby heated so that temperatures thereof are kept higher. As a result, a reduction is achieved in time required between start of rotation of the fixing belt on reception of print starting signal and recovery of a specified fixation temperature in the fixing nip.

Provided the cover that covers the space above the fixing nip is provided, heated air that has moved toward the fixing nip can be retained in vicinity of the fixing nip by the cover, and the effect described above is thereby enhanced further.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
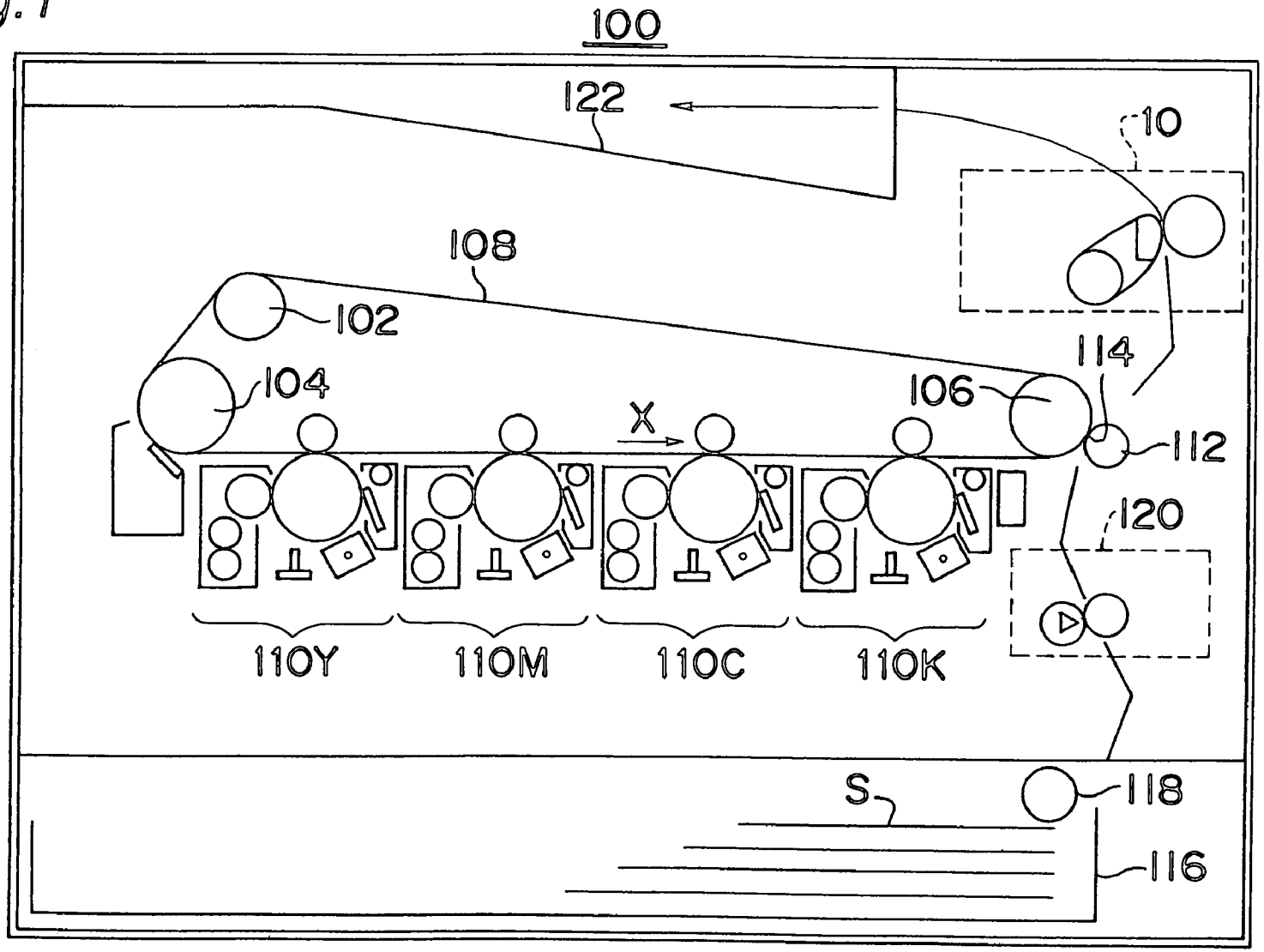
FIG. 1 is a schematic diagram of an image forming apparatus.

FIG. 1 is a schematic diagram of an image forming apparatus 100 employing a belt-type fixing device that is an embodiment of the invention. The image forming apparatus 100 has an intermediate transfer belt 108 that is supported by three rollers 102, 104, and 106 and that is driven to rotate in a direction of an arrow X.

Under the intermediate transfer belt 108 are aligned image forming units 110Y, 110M, 110C, and 110K corresponding to yellow toner (Y), magenta toner (M), cyan toner(C), and black toner (K), respectively. Toner images with the four colors can be formed and superposed on the intermediate transfer belt 108 by the image forming units 110Y, 110M, 110C, and 110K.

A transfer roller 112 is placed so as to be in contact with part of the intermediate transfer belt 108 that is supported by the roller 106. A transfer region 114 is formed between the transfer roller 112 and the intermediate transfer belt 108.

In a lower section of the image forming apparatus 100 is provided a paper feeding cassette 116 for containing papers S. The papers S contained in the paper feeding cassette 116 are fed one by one, by a paper feeding roller 118.

A paper S forwarded from the paper feeding cassette 116 is conveyed in a generally vertical direction by a paper conveying unit 120 or the like. In process of the conveyance, toner images are transferred from the intermediate transfer belt 108 onto the paper S when the paper S passes through the transfer region 114, the toner images are thereafter fixed on the paper S having the toner images when the paper s passes through the belt-type fixing device 10, and the paper S on which the toner images have been fixed is ejected onto a paper ejection tray 122 provided in an upper section of the image forming apparatus 100.

Figure 2:
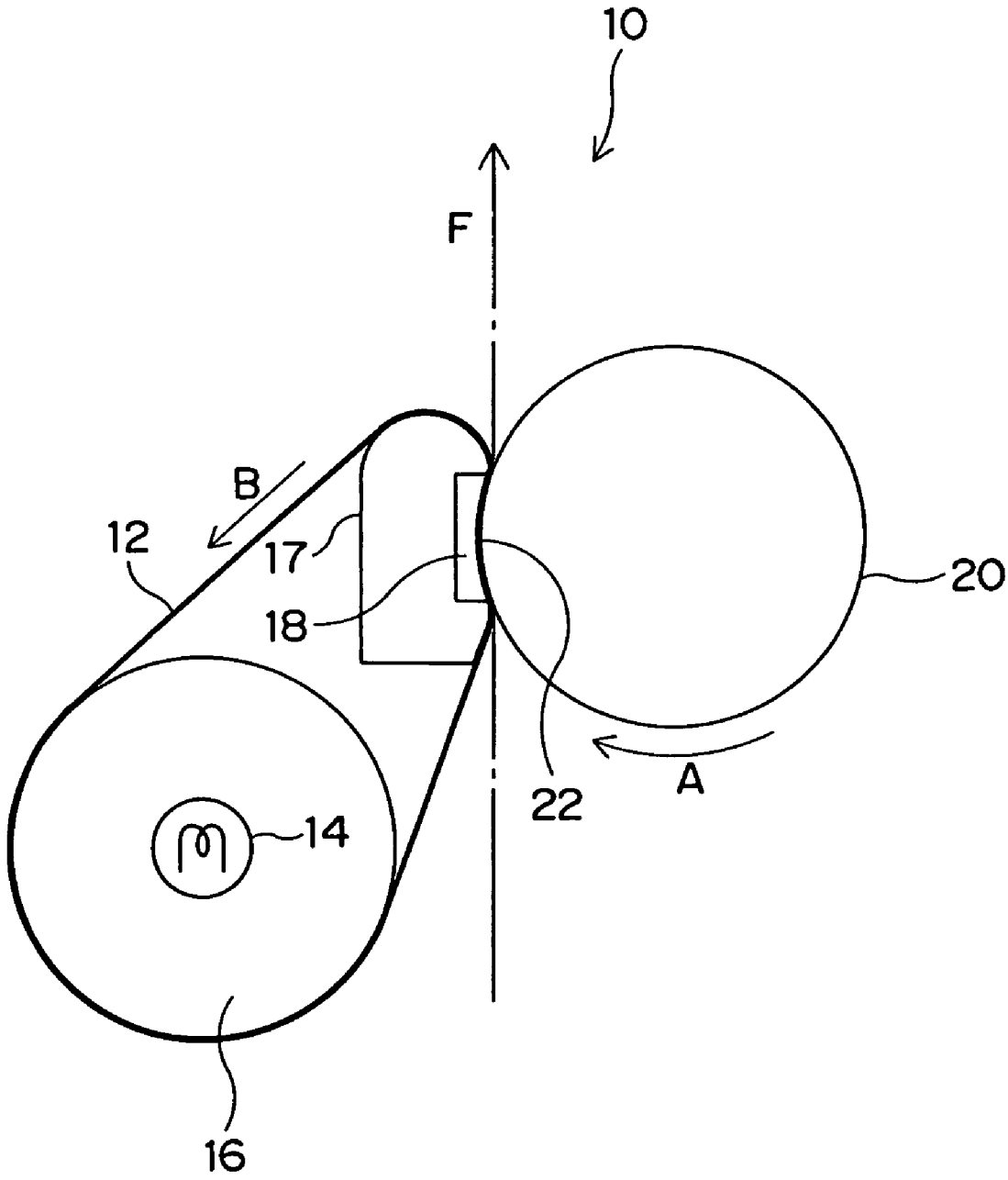
FIG. 2 shows a configuration of a belt-type fixing device.

Hereinafter, the belt-type fixing device 10 that is an embodiment of the invention will be described with reference to FIG. 2. The belt-type fixing device 10 has an endless-sheet-like fixing belt 12. The fixing belt 12 is composed of, for example, 170 μm-thick base material made of nickel or polyimide, a 200 μm-thick elastic layer made of silicone rubber, and a 30 μm-thick mold release layer made of PFA (copolymer of tetrafluoroethylene and perfluoroalkyl vinylether), which have been superimposed in order of mention from inside.

Inside the fixing belt 12 are provided a rotatable heating roller 16 which has a heater lamp (heat source) 14 therein and a nip forming member (a fixing member and a first pressurizing member) 17 which is fixed in a position away from the heating roller 16 so as to be incapable of rotating. The fixing belt 12 is wound around the heating roller 16 and the nip forming member 17 so as to be capable of rotating. The heating roller 16 is biased by a spring not shown in a direction such that the heating roller 16 goes away from the nip forming member 17, and a specified tension is thereby imparted to the fixing belt 12.

It is to be noted that the heat source for heating the fixing belt 12 is not limited to the heater lamp but may be a resistance heating element, electromagnetic induction means for generating eddy current or the like, for example.

A pressurizing roller (second pressurizing member) 20 which can be driven to be rotated is in pressure contact with the nip forming member 17 through the fixing belt 12. The pressurizing roller 20 is provided in a position generally horizontal with respect to the nip forming member 17. Thus contact part between the fixing belt 12 and the pressurizing roller 20 forms fixing nip part 22. The fixing nip 22 is in a position higher than the heating roller 16 having the heater lamp 14 within. In other words, the heating roller 16 is in a position lower than the nip forming member 17. In the pressurizing roller 20, an elastic layer composed of rubber, for example, is provided on an outer circumference of a metal core composed of a cylindrical metal tube, for example.

The nip forming member 17 is formed of heat resistant resin, metal, ceramic, glass or the like, for example, and has an elastic member 18 composed of rubber or sponge, for example, in part with which the pressurizing roller 20 is in pressure contact through the fixing belt 12. The provision of the elastic member 18 allows formation of the fixing nip 22 of which a nip pressure is comparatively low and which is wide with respect to a paper feeding direction (a direction of an arrow F).

It is to be noted that the whole nip forming member 17 may be formed of heat resistant resin or the like, without the provision of the elastic member 18. In this case, the part with which the pressurizing roller 20 is in pressure contact may have a plane surface or may have a curved concave surface extending along an outer circumferential surface of the pressurizing roller 20.

At least one thermistor (not shown) that is temperature detecting means is provided so as to be in contact with the heating roller 16, the pressurizing roller 20 or the fixing belt 12. Temperatures of the heating roller 16 and the fixing belt 12 can be set at desired values by on-off control over the heater lamp 14 based on temperatures detected by the thermistors.

In the belt-type fixing device 10 with such a configuration, the pressurizing roller 20 is driven by a motor not shown to rotate in a direction of an arrow A and the fixing belt 12 is thereby rotated in a direction of an arrow B while being slid on the nip forming member 17. While being rotated in such a manner, the fixing belt 12 is subjected to heat transfer from the heating roller 12 heated by the heater lamp 14 and temperatures on an overall periphery of the fixing belt thereby rise to a specified fixation temperature (e.g., 180° C.).

After the fixing belt 12 is heated so as to have the specified fixation temperature, a paper having unfixed toner images on a surface thereof on a side of the fixing belt 12 is conveyed in a generally vertical direction from lower side to upper side and is introduced into the fixing nip 22. The toner images are heated and fixed onto the paper while the paper is passed through the fixing nip 22.

While the belt-type fixing device 10 is standing by for printing, the rotation of the pressurizing roller 20 and the fixing belt 12 is suspended. Even while standing by for printing, the temperature of the heating roller 16 is kept at the specified fixation temperature by the heater lamp 14 subjected to the on-off control.

When the device stands by for printing, temperatures decrease in the nip forming member 17, the pressurizing roller 20, and part of the fixing belt 12 that makes the fixing nip 22, which are in the positions away from the heating roller 16 having the heater lamp 14. In the belt-type fixing device 10 of the embodiment, however, the fixing nip 22 is in the position higher than the heater lamp 14 as the heat source, and surrounding air heated by the heater lamp 14 through medium of the heating roller 16 therefore moves toward the fixing nip 22 by convection. The convection of the heated air is particularly noticeable inside the fixing belt 12. The nip forming member 17 including the elastic member 18 that forms the fixing nip 22, the pressurizing roller 20, and part of the fixing belt 12 residing in and adjacent to the fixing nip 22 are thereby heated so that temperatures thereof are kept higher.

Upon reception of print starting signal in the standby status for printing, the pressurizing roller 20 is driven to rotate and the fixing belt 12 starts rotating. At this point, the temperatures of the nip forming member 17 including the elastic member 18, the pressurizing roller 20, and the like have been kept at a high value by the convection, and time required for recovery of the specified fixation temperature in the fixing nip 22 with the heating of the fixing belt 12 by the heating roller 16 can be therefore reduced.

Figure 3:
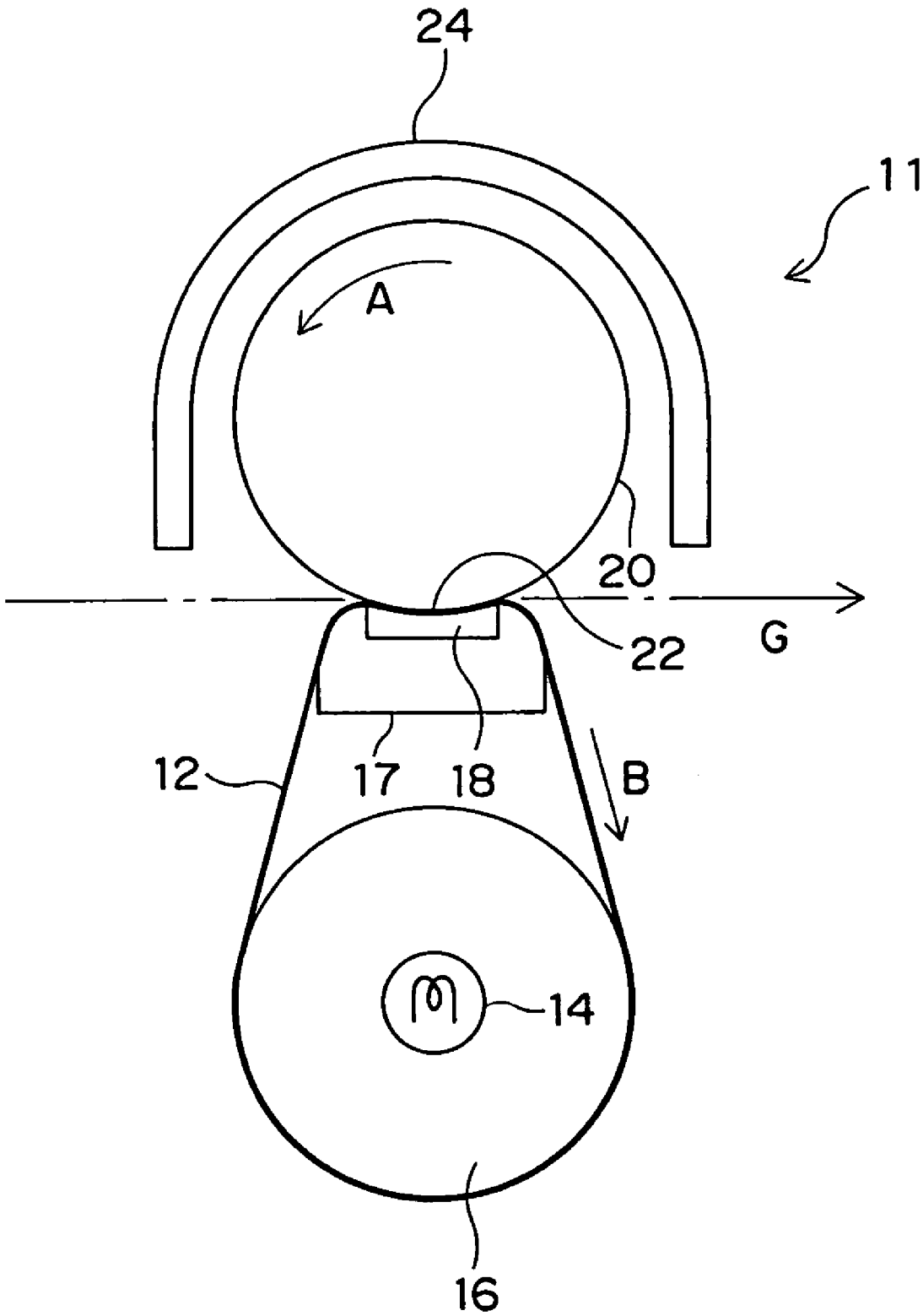
FIG. 3 shows a configuration of a belt-type fixing device in accordance with another embodiment.
Figure 4:
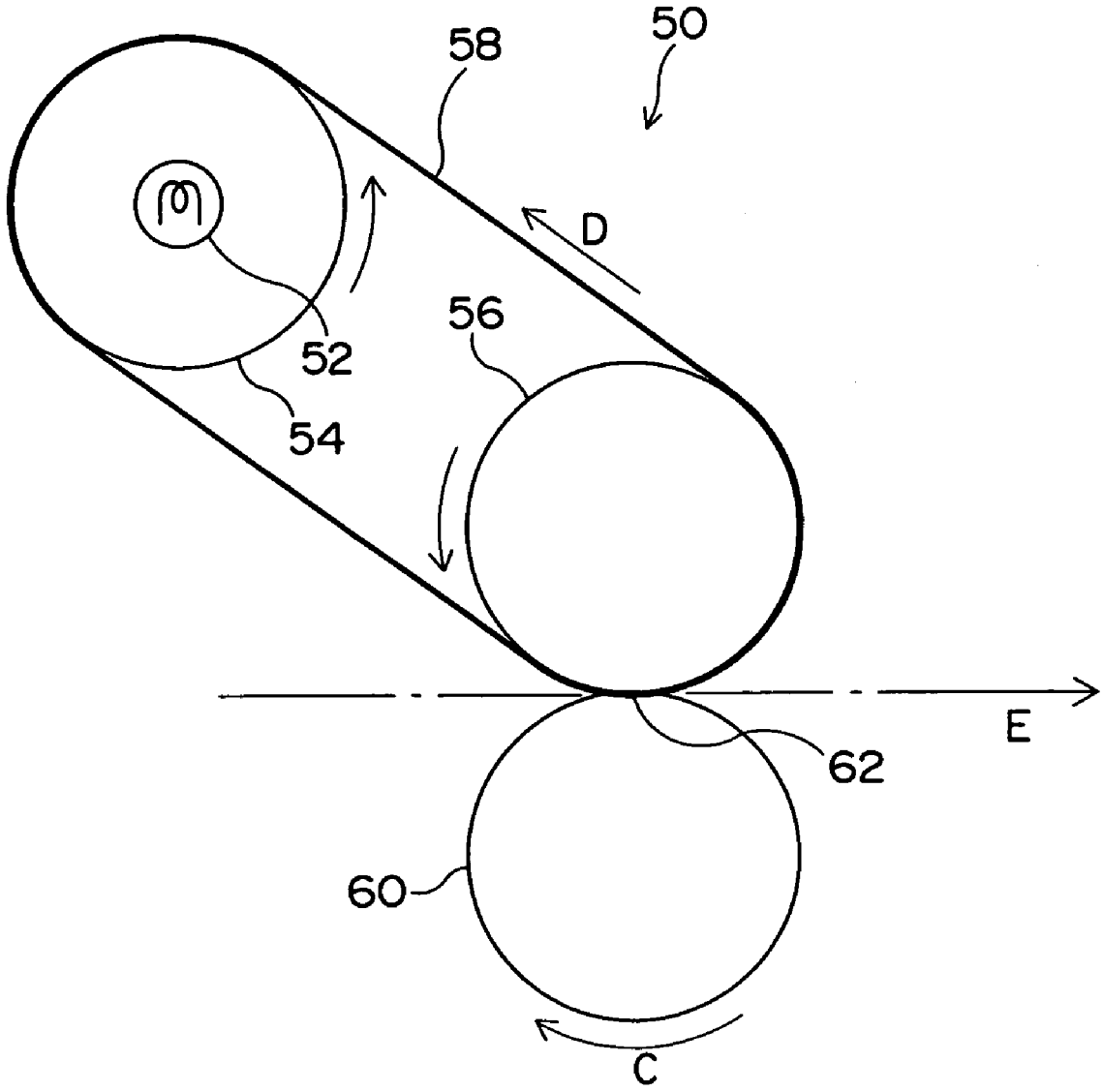
Fig. 4 PRIOR ART
FIG. 4 shows a configuration of a conventional belt-type fixing device.

Hereinafter, a belt-type fixing device 11 in accordance with another embodiment of the invention will be described with reference to FIG. 3.

In the same manner as the belt-type fixing device 10, the belt-type fixing device 11 has a fixing belt 12, a heating roller 16 having a heater lamp 14, a nip forming member 17 having an elastic member 18, and a pressurizing roller 20.

The paper feeding direction of the belt-type fixing device 10 is generally vertical, whereas the belt-type fixing device 11 is configured so that a paper feeding direction (a direction of an arrow G) is generally horizontal. In the belt-type fixing device 11, a cover 24 that covers a space above a fixing nip 22 is provided around the pressurizing roller 20. Preferably, material of the cover 24 is heat resistant resin with a small heat transfer coefficient (such as PPS (polyphenylene sulfide) and PET (polyethylene terephthalate)), for purpose of minimizing heat radiation to outside of the cover 24. The material, however, may be metal material with a high heat transfer coefficient (such as iron and stainless steel) on condition that heat insulating sheets such as nonwoven fabric are pasted on an inner surface of the cover 24.

The belt-type fixing device 11 of the embodiment achieves an effect similar to that of the belt-type fixing device 10 (that is, the belt-type fixing device 11 is capable of reducing time required between start of rotation of the fixing belt 12 on reception of print starting signal in the printing-standby status and recovery of a specified fixation temperature in the fixing nip 22). Besides, the provision of the cover 24 enhances the effect because heated air that has moved toward the fixing nip 22 stays in vicinity of the fixing nip 22.

In the belt-type fixing devices 10 and 11, it is to be noted that the nip forming-member 17 that is fixed inside the fixing belt 12 so as to be incapable of rotating is used as a fixing member. In place of the nip forming member 17, however, a rotatable fixing roller having an elastic layer on an outer circumference thereof may be used as the fixing member, as is the case with the conventional belt-type fixing device 50.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A belt-type fixing device, comprising:

a nip forming member fixed so as to be incapable of rotating;

a heating roller including a heat source which is provided away from the nip forming member;

a fixing belt wound around the nip forming member and around the heating roller; and a rotatable pressurizing roller which is in pressure contact with the nip forming member with the fixing belt interposed between and in which a part in contact with the fixing belt forms a fixing nip, wherein the fixing nip is in a position higher than the heating roller and wherein the fixing nip is configured so that a paper that undergoes fixation is passed from a lower side to an upper side in the fixing nip, and wherein the rotatable pressurizing roller is provided in a position generally horizontal with respect to the nip forming member and wherein the rotatable pressurized roller is configured so that the paper that undergoes fixation is conveyed in a generally vertical direction from the lower side to the upper side.

2. A belt-type fixing device as in claim 1, wherein the pressurizing roller is driven by a motor and the fixing belt is thereby rotated.

3. A belt-type fixing device as in claim 1, wherein a cover that covers a space above the fixing nip is provided and wherein the cover only covers the circumference of the rotatable pressurizing roller.

4. An image forming apparatus, comprising:

an image forming unit for forming a toner image on a paper;

a nip forming member fixed so as to be incapable of rotating;

a heating roller that is in a position away from and lower than the nip forming member;

a fixing belt wound around the nip forming member and around the heating roller;

a rotatable pressurizing roller which is in pressure contact with the nip forming member with the fixing belt interposed between and in which a part in contact with the fixing belt forms a fixing nip; and a paper conveying unit configured for conveying the paper on which the toner image has been formed by the image forming unit, in a generally vertical direction from a lower side to an upper side, in the fixing nip formed between the fixing belt and the rotatable pressurizing roller to undergo fixation of the toner image, wherein the nip forming member and the heating roller are separate and independent from each other and wherein the rotatable pressurizing roller is provided in a position generally horizontal with respect to the nip forming member and wherein the rotatable pressurized roller is configured so that paper that undergoes fixation is conveyed in the generally vertical direction from the lower side to the upper side.

5. An image forming apparatus as in claim 4, wherein the pressurizing roller is driven by a motor and the fixing belt is thereby rotated.

* * * * *